US009567677B2

(12) United States Patent
Ghanem et al.

(10) Patent No.: US 9,567,677 B2
(45) Date of Patent: Feb. 14, 2017

(54) ELECTROCHEMICAL METHOD OF PRODUCING HYDROGEN PEROXIDE USING A TITANIUM OXIDE NANOTUBE CATALYST

(71) Applicant: KING SAUD UNIVERSITY, Riyadh (SA)

(72) Inventors: Mohamed Ali Mohamed Ghanem, Southampton (GB); Abdullah Mohamed Almayouf, Riyadh (SA); Maged Najy Yahya Shaddad, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 24 days.

(21) Appl. No.: 14/681,038

(22) Filed: Apr. 7, 2015

(65) Prior Publication Data

US 2016/0298245 A1 Oct. 13, 2016

(51) Int. Cl.

| | |
|---|---|
| ***C25B 1/00*** | (2006.01) |
| ***C25B 1/30*** | (2006.01) |
| ***C25B 11/04*** | (2006.01) |
| ***C25B 11/02*** | (2006.01) |

(52) U.S. Cl.

CPC ..... *C25B 1/30* (2013.01); *C25B 11/02* (2013.01); *C25B 11/0478* (2013.01)

(58) Field of Classification Search

None

See application file for complete search history.

(56) References Cited

U.S. PATENT DOCUMENTS

| | | | | |
|---|---|---|---|---|
| 6,939,630 | B2 | 9/2005 | Sotomura et al. | |
| 2007/0074975 | A1* | 4/2007 | Buschmann | C02F 1/4672 205/466 |

FOREIGN PATENT DOCUMENTS

| | | | |
|---|---|---|---|
| CN | 101110453 | A | 1/2008 |
| WO | WO 2007/120176 | A2 | 10/2007 |

OTHER PUBLICATIONS

Sohn et al., Electrochemically assisted photocatalytic degradation of methyl orange using anodized titanium dioxide nanotubes, (2008), Applied Catalysis B: Environmental 84, pp. 372-378.*

Xiao at al., "Nanostructured Electrode with Titania Nanotube Arrays: Fabrication, Electrochemical Properties, and Applications for Biosensing," Journal of Nanoscience and Nanotechnology, 2008, vol. 8, pp. 1-11.

(Continued)

*Primary Examiner* — Arun S Phasge

(74) *Attorney, Agent, or Firm* — Richard C. Litman

(57) ABSTRACT

The electrochemical method of producing hydrogen peroxide using a titanium oxide nanotube catalyst is an electrochemical process for producing hydrogen peroxide using a cathode formed as a nanostructured titania ($TiO_2$) electrode surface treated with nitrogen. An anode and the cathode are immersed in an alkaline solution saturated with oxygen in an electrolytic cell. An electrical potential is established across the cathode and the anode to initiate electrochemical reduction of the oxygen in the alkaline solution to produce hydrogen peroxide dissolved in the alkaline solution. The hydrogen peroxide dissolved in the alkaline solution is then collected from the cell.

9 Claims, 15 Drawing Sheets

(56) References Cited

OTHER PUBLICATIONS

LiXia Yang et al. "A review on TiO2 nanotube arrays: Fabrication, properties, and sensing applications," Chinese Science Bulletin, Feb. 2010, vol. 55, properties, and sensing No. 9-5, pp. 331-338.
Ishihara et al., "Electrochemical synthesis of titania nanotube array for photoelectrochemical hydrogen production", Proc. ESA Annual Meeting on Electrostatics (2009), 6 pages.

* cited by examiner

ELECTROCHEMICAL METHOD OF PRODUCING HYDROGEN PEROXIDE USING A TITANIUM OXIDE NANOTUBE CATALYST

BACKGROUND OF THE INVENTION

1. Field of the Invention

The present invention relates to electrochemical processes, and particularly to an electrochemical method of producing hydrogen peroxide using a titanium oxide nanotube catalyst that uses an electrode with $TiO_2$ nanotubes annealed with nitrogen for the production of hydrogen peroxide by the electrochemical reduction of oxygen in an alkaline solution.

2. Description of the Related Art

Hydrogen peroxide ($H_2O_2$) is an environmentally-friendly oxidizing agent which is extensively used in environmental disinfection and in the chemical industry as an oxidizing chemical reagent, a bleaching agent for textiles and paper products, and for cleaning, stripping and etching processes in the semiconductor industry. Water is the sole degradation product of hydrogen peroxide, thus making it extremely desirable from an environmental standpoint.

The industrial production of hydrogen peroxide is typically performed by an anthraquinone reduction reaction (typically referred to as the "AQ process"), which involves the hydrogenation of anthraquinone derivatives (with a catalyst, such as nickel or palladium), which produces the corresponding hydroquinones, followed by oxidation with oxygen (typically from air) to yield hydrogen peroxide and reproduce the initial anthraquinone. The AQ process, however, involves successive hydrogenation and oxidation of an alkyl-anthraquinone precursor, which is dissolved in a mixture of organic solvents, followed by liquid-liquid extraction and recovery of $H_2O_2$. This multistep method consumes significant energy input and generates large amounts of waste. Additionally, the $H_2O_2$ product is often contaminated with organic waste and byproducts, which must be constantly removed throughout the process. Thus, a more efficient method for the direct synthesis of $H_2O_2$ from oxygen ($O_2$) would obviously be desirable.

Other methods used for the production of $H_2O_2$ include electrochemical oxygen reduction and direct synthesis from hydrogen and oxygen in the presence of noble metal catalysts supported on silica, alumina or carbon. The only viable electrolytic $H_2O_2$ production process that competes with the AQ process is the Dow process, which was developed for on-site site production of $H_2O_2$ by cathodic reduction of oxygen using a graphite electrode in a trickle bed cell. The $H_2O_2$ solution produced by the process is directly used in pulp bleaching and in the processing of recycled paper. The production of $H_2O_2$ relies on the electrolysis of $O_2$ in alkaline solutions in an electrochemical cell using a carbon cathode, and the electrochemical reactions at the anode and cathode are respectively given by:

$$2OH^- \rightarrow H_2O + \tfrac{1}{2}O_2 + 2e^- \quad (1)$$

$$H_2O + O_2 + 2e^- \rightarrow HO_2^- + OH^- \quad (2)$$

The evolution of oxygen at the anode in reaction (1) is very beneficial, as it can diffuse through a flow electrolyte and be reduced at the cathode, as shown in reaction (2), to produce $H_2O_2$ (i.e., a self-feeding process). The cathode in the Dow process is made from graphite coated with carbon black and a fluorocarbon binder to facilitate $O_2$ transfer at atmospheric pressure. A cell operating at 2.3 V and 62 mA/cm$^2$ yields $NaOH/HO_2^-$ at a weight ratio of 1.6-1.8 to 1 and at a current efficiency of 90%. This alkali peroxide technology is well suited to bleaching applications, where it is not necessary to separate the peroxide from the caustic soda in the product.

FIG. 9 illustrates a typical prior art electrochemical cell 1 for performing such reactions as the Dow process. The cell 1 includes a central cathode structure 3 and an outer, surrounding anode 4, which is supported on the interior of the cell 1. An alkaline electrolyte 5 is retained by the cell 1 between the anode 4 and the exterior surface 6 of cathode 3. The anode 4 and cathode 3 are separated by a cylindrical diaphragm 7. Electrical leads 8, 9 to the anode 4 and cathode 3, respectively, provide electrical energy to the system. A cooling coil 10 is often employed in such reaction cells.

The cathode 3 is of generally cylindrical shape and includes a lead-in conduit 11 for carrying oxygen or oxygen-containing gases to the cathode interior, where it travels to the exterior face 6 of the cathode 3 through the porous body 12 of the cathode. The conduit 11 and the porous body 12 are electrically conductive. The cathode body 12 is of porous graphite and will pass the necessary oxygen-containing gas constituent.

Photocatalytic formation methods of $H_2O_2$ over semiconductor oxides have also been investigated in recent years. Reactive oxygen-containing species (ROS), namely $OH^-$, $O_2^-$, and $H_2O_2$, are usually formed at the surface of titanium oxide ($TiO_2$) under UV irradiation. $TiO_2$ anatase and rutile crystalline forms as photoactive catalysts have shown different reactivities for the photo-production of $H_2O_2$. The anatase is produced at a lower temperature than the rutile phase and has shown higher photo-activity due to the presence of a higher density of surface defects, such as oxygen vacancies and sub-oxides, than the rutile form, which contributes to the higher catalytic activity observed for the production of hydrogen peroxide on anatase powder. However, the concentrations of $H_2O_2$ produced using photo-irradiated $TiO_2$ surfaces are in the micromolar range, which does not meet the requirements for industrial scale production.

$TiO_2$ nanotube (TON) catalysts are self-assembled via anodization and have attracted considerable interest in recent years due to their unique nanoscale features and electronic properties. TON has unique semiconducting properties, chemical inertness and stability, is cost effective and resistant to corrosion, and has applications in numerous fields, such as photocatalysis, solar cells, electronic devices, and environmental cleaning and protection. TON arrays prepared by anodization typically exhibit relatively low electrical conductivity, which limits applications in electrocatalysis and use as a catalyst support. Thus, various methods for generating oxygen vacancies, such as metal and non-metal doping, are often employed to improve the electrical conductivity and reactivity of TON structures to satisfy the requirements for effective electrode materials.

The oxygen reduction reaction (ORR) in aqueous solutions occurs primarily through two pathways, the direct 4-electron reduction pathway from $O_2$ to $H_2O$, and the 2-electron reduction pathway from $O_2$ to hydrogen peroxide ($H_2O_2$). In non-aqueous aprotic solvents and/or in alkaline solutions, the 1-electron reduction pathway from $O_2$ to superoxide ($O_2^-$) can also occur. The electrochemical reduction of oxygen (ORR) has been found to occur on various forms of plain titanium dioxide at a much higher overvoltage in acid and alkaline media. It has also been found that the overvoltage for ORR is significantly reduced after activation of the $TiO_2$ layer by cyclic polarization. However, despite recent experiments, such methods have yet to achieve the effective production of hydrogen peroxide on TON arrays in alkaline media.

Thus, an electrochemical method of producing hydrogen peroxide using a titanium oxide nanotube catalyst solving the aforementioned problems is desired.

SUMMARY OF THE INVENTION

The electrochemical method of producing hydrogen peroxide using a titanium oxide nanotube catalyst is an electrochemical process for producing hydrogen peroxide using a cathode formed as a nanostructured titania ($TiO_2$) electrode surface treated with nitrogen. An anode and the cathode are immersed in an alkaline solution, such as potassium hydroxide (KOH) solution, saturated with oxygen in an electrolytic cell. An electrical potential is established across the cathode and the anode to initiate electrochemical reduction of the oxygen in the alkaline solution to produce hydrogen peroxide dissolved in the alkaline solution. The hydrogen peroxide dissolved in the alkaline solution is then collected from the cell. The $TiO_2$ nanotube array forming the generator electrode has been treated with nitrogen by annealing in nitrogen atmosphere, doping with nitrogen plasma, or the like to modify the surface of the titania. The anode is preferably formed from nickel mesh or Raney nickel.

These and other features of the present invention will become readily apparent upon further review of the following specification.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

The electrochemical method of producing hydrogen peroxide using a titanium oxide nanotube catalyst is an electrochemical process for producing hydrogen peroxide using an electrode formed from nanostructured titania ($TiO_2$) treated in a nitrogen atmosphere, preferably a $TiO_2$ nanotube array annealed in nitrogen atmosphere, although the electrode may be porous, nanowires, a nanoparticle coating, or other nanostructured titania electrode. An anode (i.e., a collector electrode), such as a carbon, platinum or nickel mesh electrode, and a cathode (i.e, a generator electrode) formed from the $TiO_2$ nanotube array are immersed in an alkaline solution, such as a KOH solution, saturated with oxygen in an electrolytic cell, as is conventionally known in electroreduction processes. Preferably, the anode is formed from nickel mesh or Raney nickel (a fine-grain form of nickel having a relatively large surface area) due to the greater efficiency in the oxygen evolution half reaction at the anode in the base electrolyte. Both nickel mesh and Raney nickel are stable and have low oxygen overvoltages. Additionally, both materials will not catalyze a decomposition of hydrogen peroxide produced at the cathode.

Figure 9:
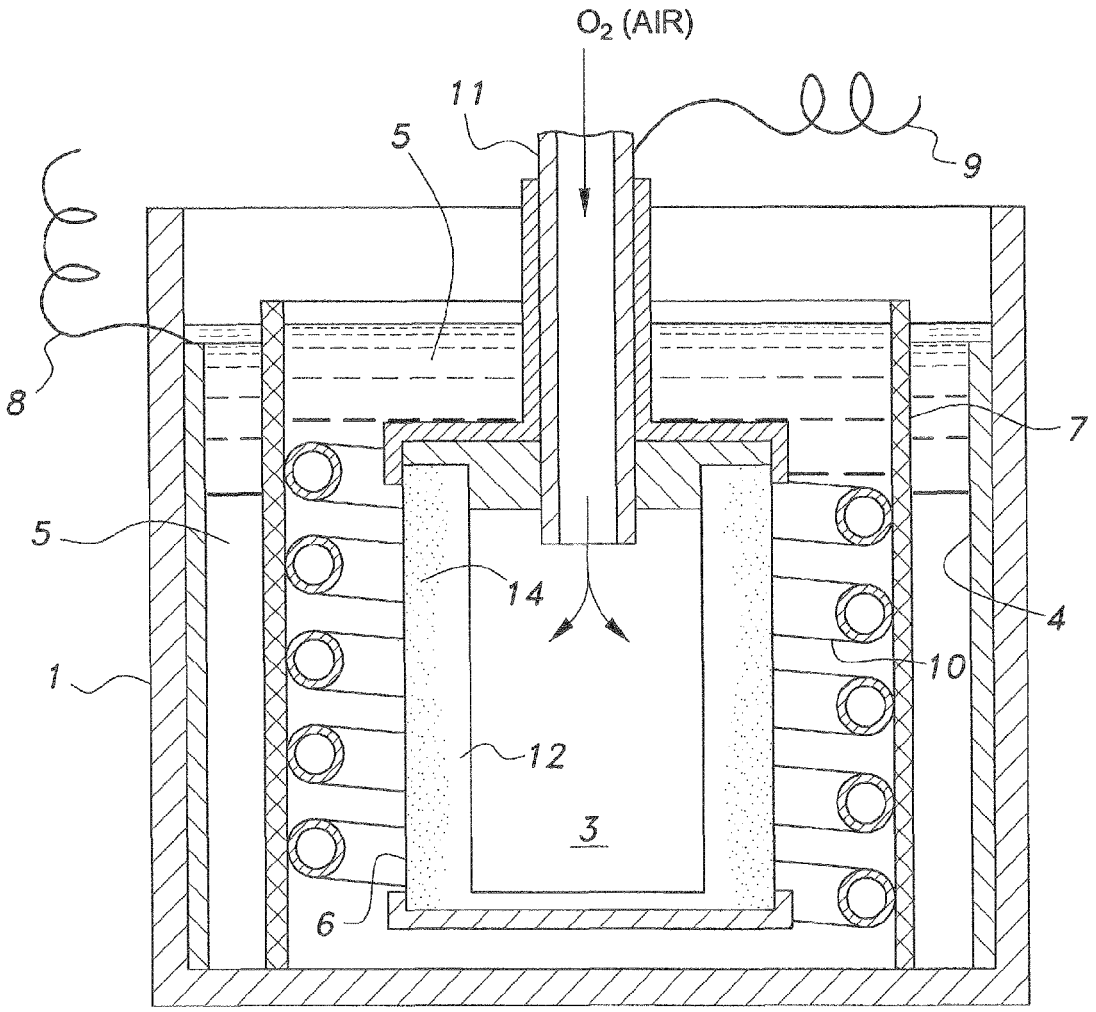
Prior Art Fig. 9
FIG. 9 illustrates an electrochemical cell for producing peroxide solutions via the Dow process according to the prior art.
Figure 10:
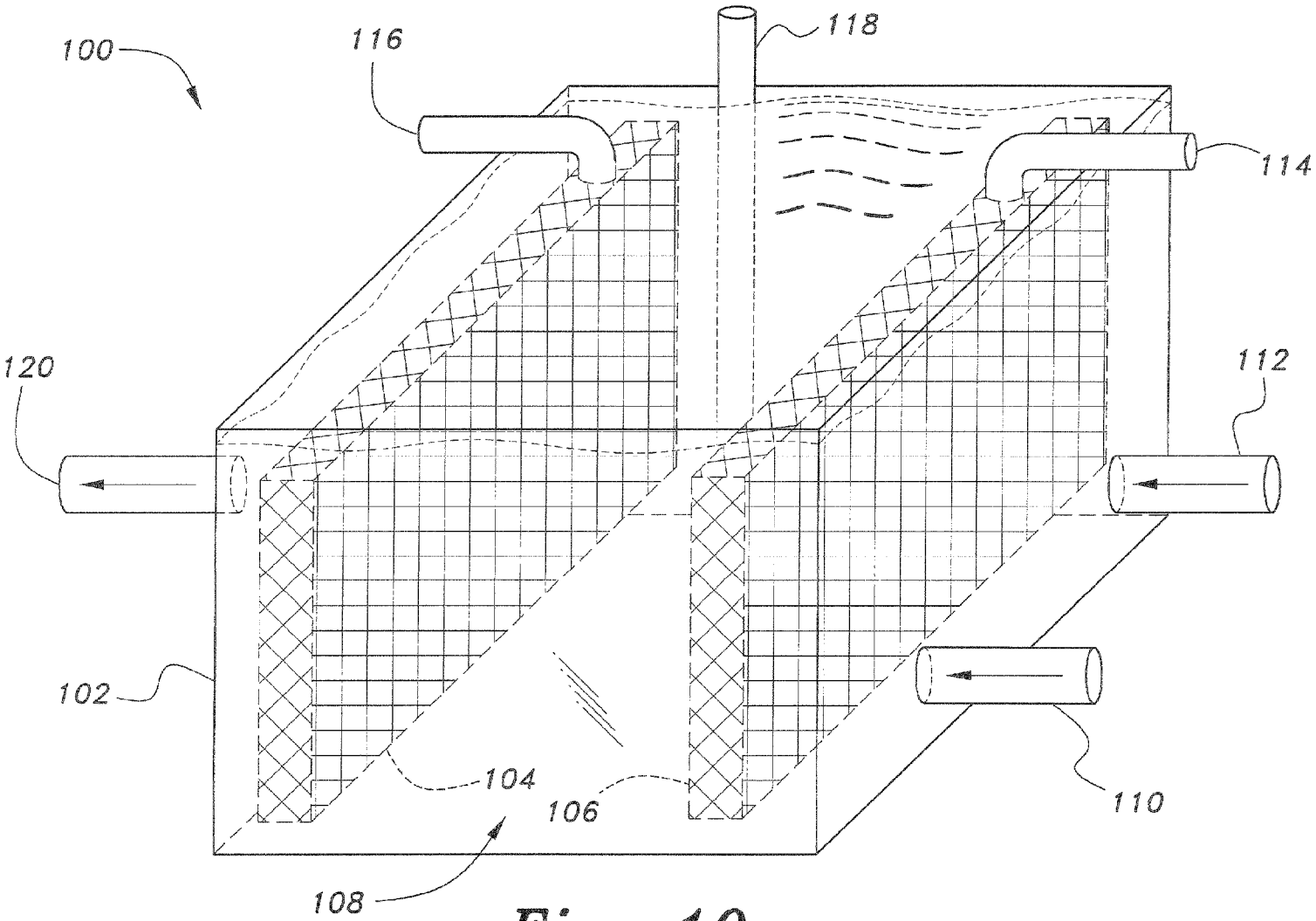
FIG. 10 diagrammatically illustrates a flow cell for implementing the electrochemical method of producing hydrogen peroxide using a titanium oxide nanotube catalyst according to the present invention.

The $TiO_2$ nanotube array generator electrode may be similar to generator electrode 3 of the electrochemical cell shown in FIG. 9, although it should be understood that any suitable type of electrolytic or electrochemical cell may be utilized, such as the exemplary flow cell 100, shown in FIG. 10. Flow cell 100 includes a conventional cell frame or housing 102 which receives spaced apart cathode 104 and anode 106, as shown. In conventional flow cells, the housing or cell frame is typically made from glass or similar non-reactive materials. The alkaline electrolyte 108 fills the cell, and is input through electrolyte inlet port 110. An air inlet port 112 is further provided for saturating the electrolyte with oxygen. An electrical potential is established across anode contact 114 and cathode contact 118 to initiate the electrochemical reduction. Such flow cells are known in the art, and flow cell 100 is preferably a conventional three-electrode, single-compartment type flow cell, including cathode 104, anode 106 and reference electrode 118. As the cell frame or housing 102 is preferably sealed, an outlet port 120 is provided for releasing the hydrogen peroxide produced by the electrochemical reaction. Establishing the electrical potential across cathode contact 116 and anode contact 114 initiates the electrochemical reduction of the oxygen in the alkaline solution 108 to produce hydrogen peroxide (dissolved in the electrolyte solution), which is then collected through outlet port 120. The $TiO_2$ nanotube array forming the cathode 104 is treated with nitrogen, either by annealing the array in nitrogen atmosphere, doping the array with nitrogen plasma, or any other suitable process for modifying the surface of the titania with nitrogen. It should be understood that nitrogen may be replaced by any other suitable dopant which creates defects within the $TiO_2$ nanotubes crystal lattice.

The method was tested by fabricating $TiO_2$ nanotube arrays, although it will be understood that the titania electrode may be formed from any nanostructured titania material, e.g., nanowires, nanoparticles applied as a coating, porous titania nanostructures, etc. The $TiO_2$ nanotube arrays were made by anodizing titanium foil in hydrogen fluoride solution, although it should be understood that any other suitable method for fabricating $TiO_2$ nanotubes could be utilized. Following this fabrication, the foils were annealed in air (TON-air) or in nitrogen (TON-$N_2$) atmospheres at 450° C. The titanium foil was 99.5% pure titanium in 20 mm×30 mm×0.25 mm sheets that were washed in deionized water, degreased by sonication in isopropanol, acetone, and finally washed with deionized water followed by air-drying. The foil was anodized at 20 V in 0.5% HF solution for 20 minutes at room temperature using the foil as anode placed 2.0 cm from a platinum foil cathode. The foils were washed in deionized water. Samples that received no further treatment are designated as TON-as. Other samples were annealed at 450° C. in air or $N_2$ atmospheres (designated as TON-air and TON-$N_2$, respectively) for 3.0 hrs with a heating and cooling rate of 5° C. $min^{-1}$ to produce anastase crystallization. Cyclic voltammetry was performed in a conventional three-electrode, single compartment pyrex glass cell using a computerized potentiostat/galvanostat (Autolab, PGSTAT30) with NOVA 1.8 software or a two-channel Biologic PSV potentiostat/galvanostat. The reference and auxiliary electrodes were saturated calomel (SCE) and pure Pt foil, respectively. The geometric area of the working electrode was 0.68 $cm^2$.

Figure 1A:
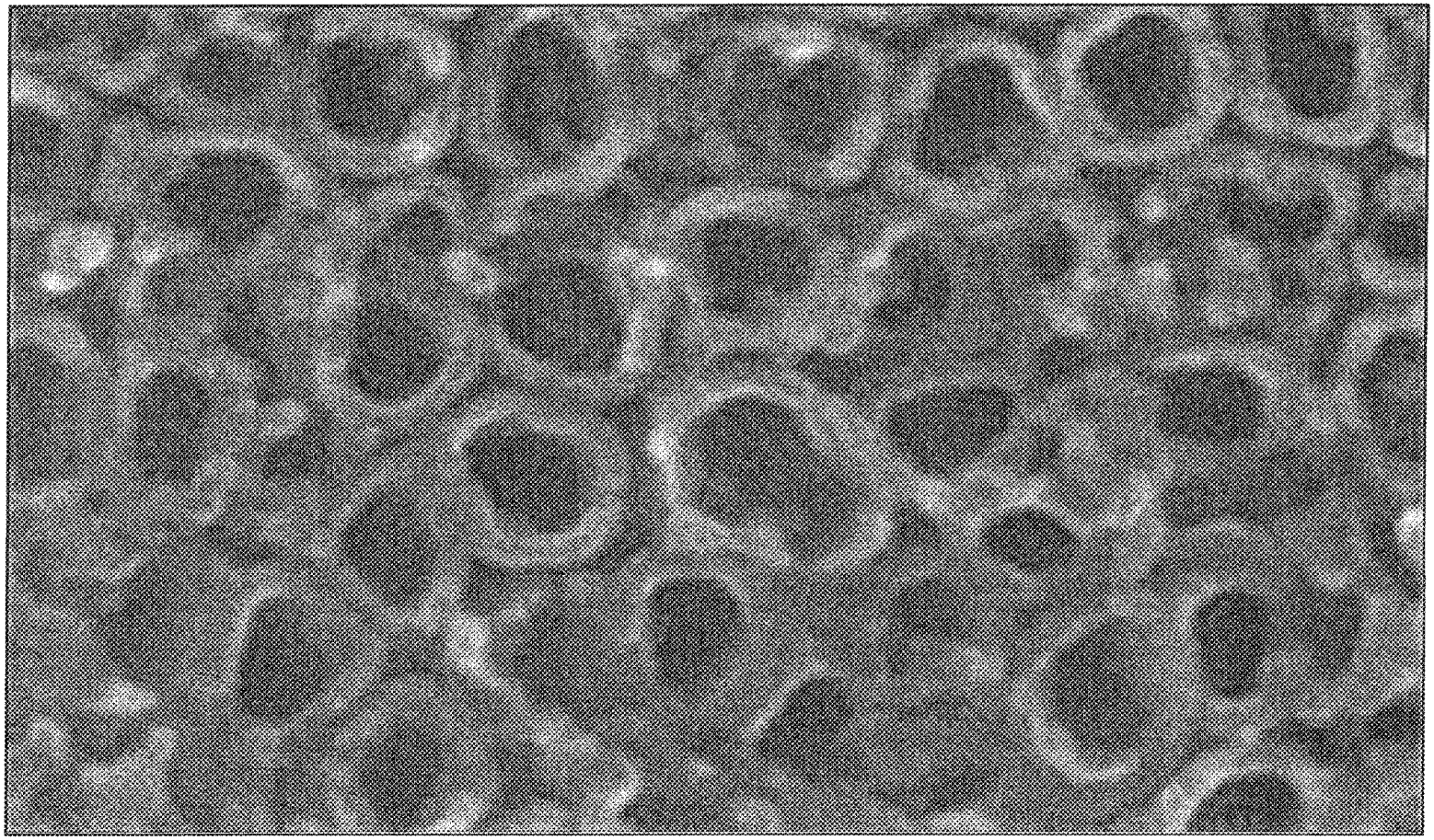
FIG. 1A is a scanning electron micrograph (SEM) showing a surface image of a $TiO_2$ nanotube (TON) array annealed in an air flow (TON-air), which was used for comparison purposes in the electrochemical method of producing hydrogen peroxide using a titanium oxide nanotube catalyst according to the present invention.
Figure 1B:
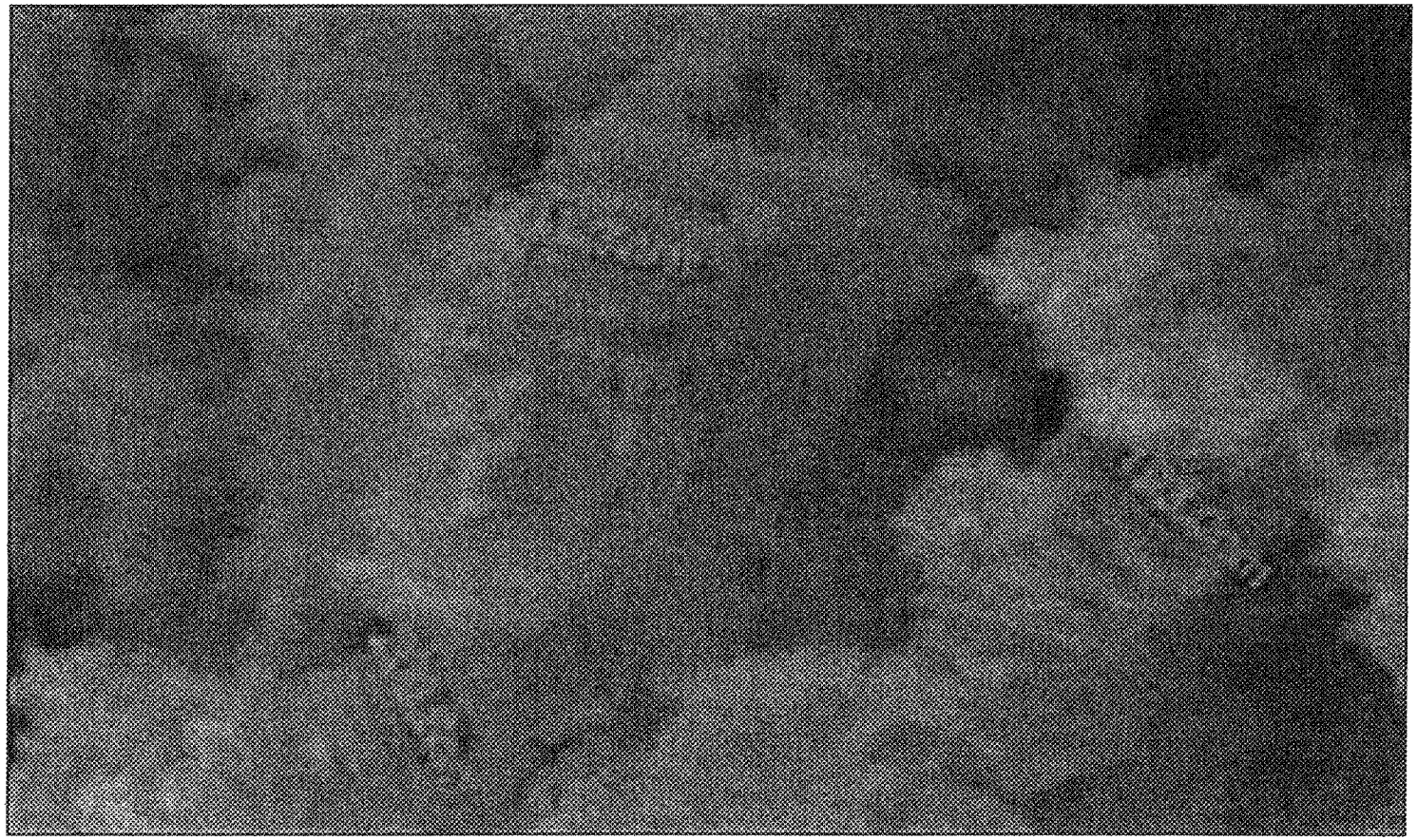
FIG. 1B is a scanning electron micrograph showing a cross-section of the $TiO_2$ nanotube (TON) array of FIG. 1A.
Figure 1C:
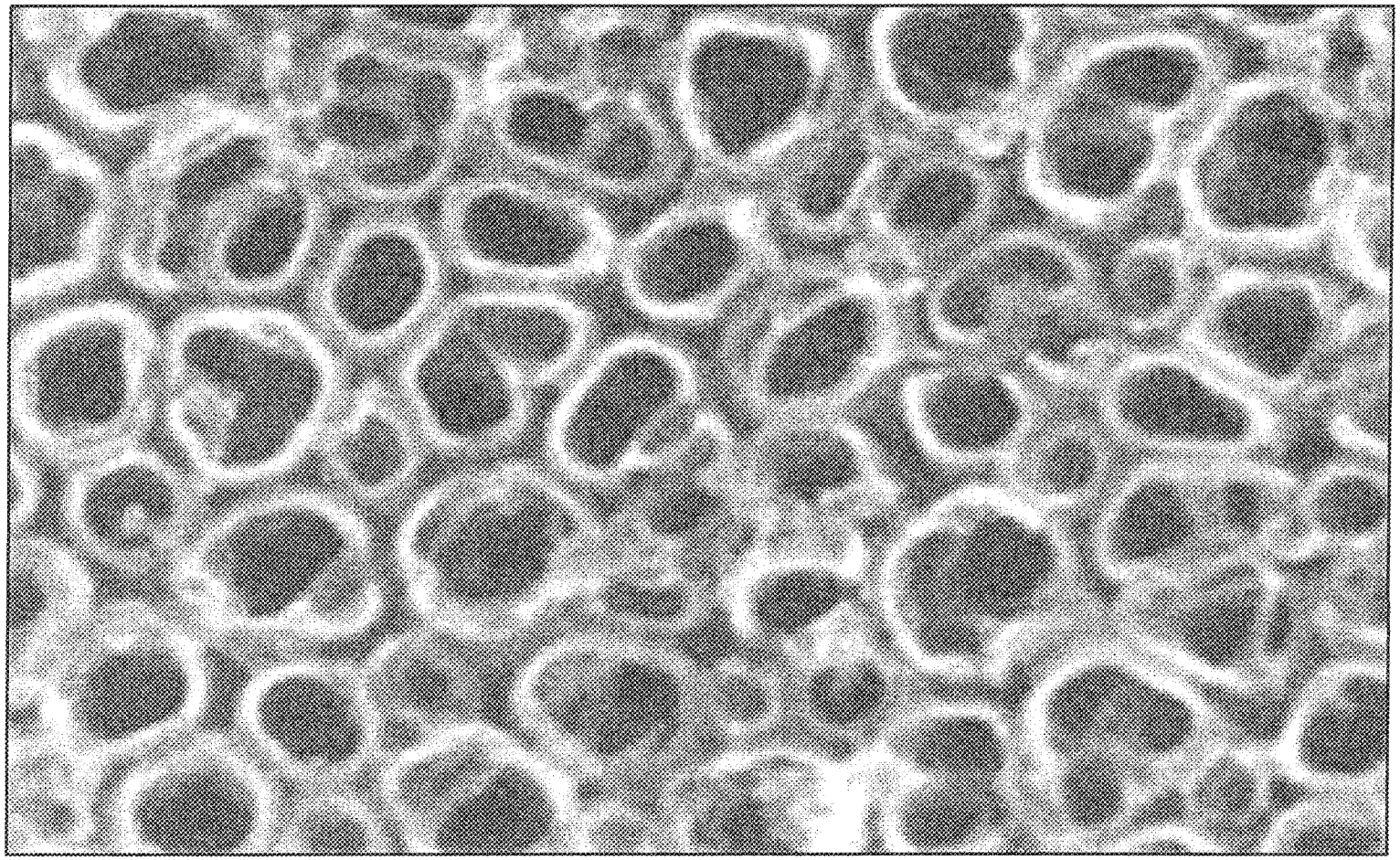
FIG. 1C is a scanning electron micrograph (SEM) showing a surface image of a $TiO_2$ nanotube (TON) array annealed in an $N_2$ atmosphere (TON-$N_2$), which may be used as an electrode material in the electrochemical method of producing hydrogen peroxide using a titanium oxide nanotube catalyst according to the present invention.
Figure 1D:
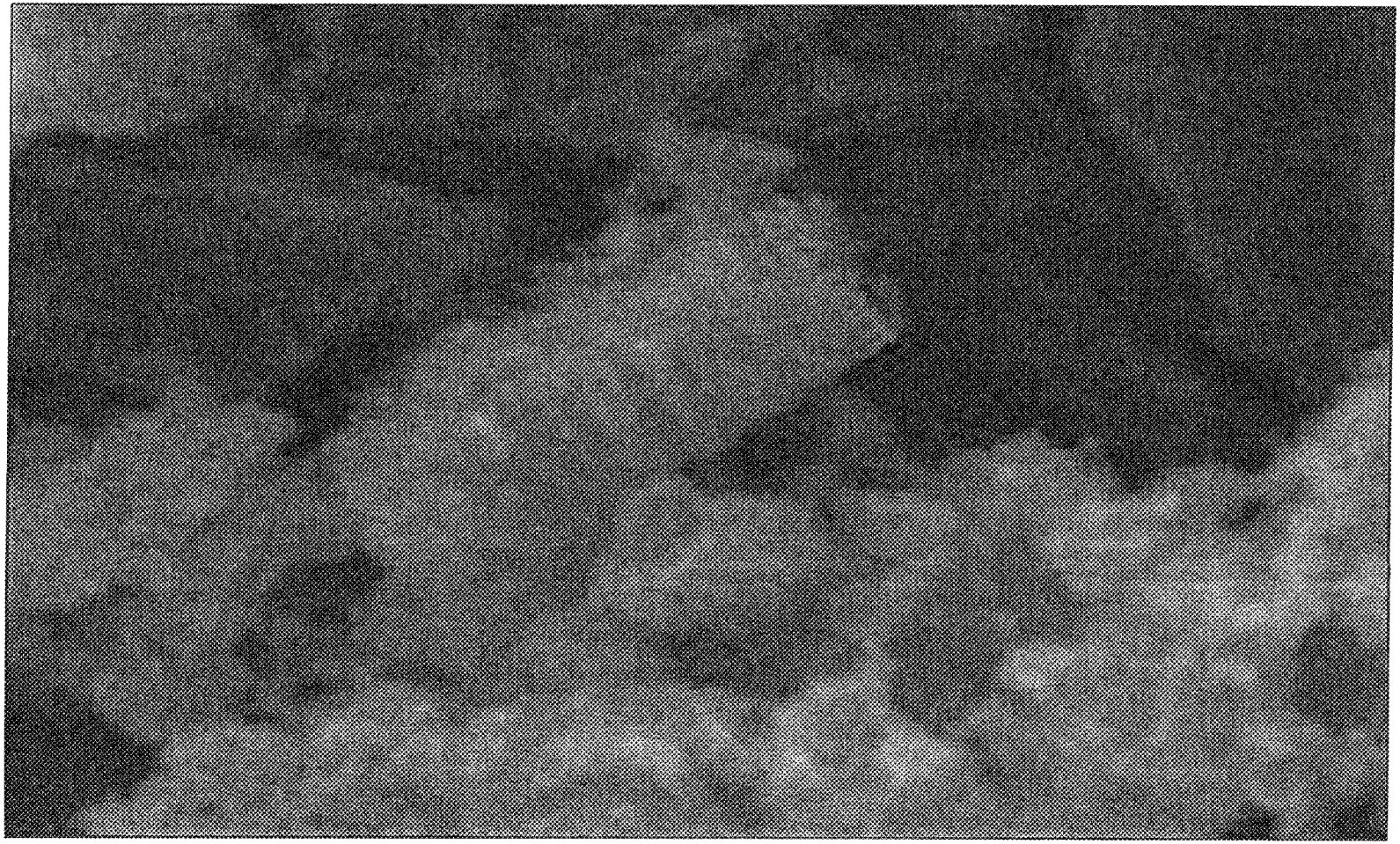
FIG. 1D is a scanning electron micrograph showing a cross-section of the $TiO_2$ nanotube (TON) array of FIG. 1C.

The structure and morphology of the $TiO_2$ nanotube (TON) arrays were characterized by scanning electron microscopy (SEM). FIGS. 1A-1D are SEM micrographs showing surface and cross-sectional images for as-anodized TONs prepared as described above, the TONs in FIGS. 1A and 1B being annealed in air and the TONs in FIGS. 1C and 1D being annealed in nitrogen. The formation of densely packed arrays of nanotubes is apparent in the micrographs, with an average pore diameter of 70 nm and an average thickness of 250 nm. The wall thickness is about 20-30 nm for both TON-air and TON-$N_2$. X-ray diffraction was also performed, revealing that both TON-air and TON-$N_2$ are polycrystalline, and contain both anatase and rutile phases, as expected.

Figure 2:
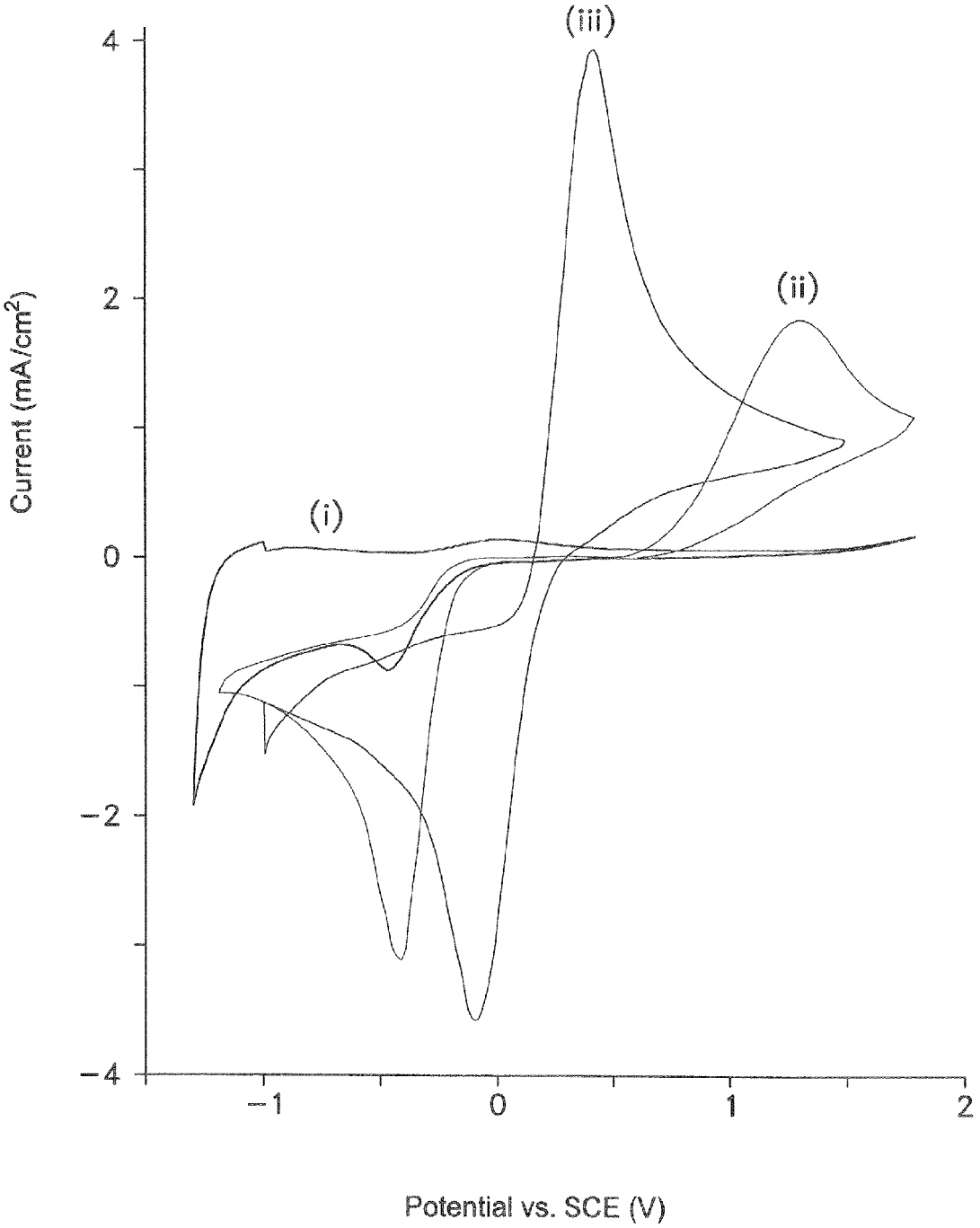
FIG. 2 is a cyclic voltammogram comparing (i) a TON-as anodized electrode, (ii) a TON-air electrode, and (iii) a TON-$N_2$ electrode in a 1.0 M KCl solution containing 5 mM $K_4[Fe(CN)_6]$ and 5 mM $K_3[Fe(CN)_6]$ at 50 mV/s.

The electrochemical behavior of as-anodized and annealed TON arrays was investigated in $Fe(CN)_6^{3-/4-}$ solution. FIG. 2 shows cyclic voltammograms at 50 mV/s for TON-as anodized (without further annealing), TON-air and for TON-$N_2$ electrodes immersed in a 1.0 M KCl solution containing 5 mM $K_4[Fe(CN)_6]$ and 5 mM $K_3[Fe(CN)_6]$. As shown in FIG. 2, the as-anodized TON electrode shows only a small reduction peak at −0.5 V vs. SCE, while the TON-air and TON-$N_2$ electrodes show well-defined redox peaks.

As further seen in FIG. 2, the TON-$N_2$ electrode shows slightly higher redox peak currents, which demonstrates higher electrochemical reversibility. Additionally, the peak-to-peak separation for TON-air and TON-$N_2$ are 1.70 V and 0.50 V, respectively, which indicates the improvement of the TON array electron transfer process after annealing in the $N_2$ atmosphere. The bulk conductivity of the TON material appears to be less important compared to the interfacial electron transfer reactivity that is affected by annealing, as expected, since TON arrays annealed in nitrogen are expected to show between three and ten times greater electrical conductivity compared to that for samples annealed in air or argon.

Figure 3:
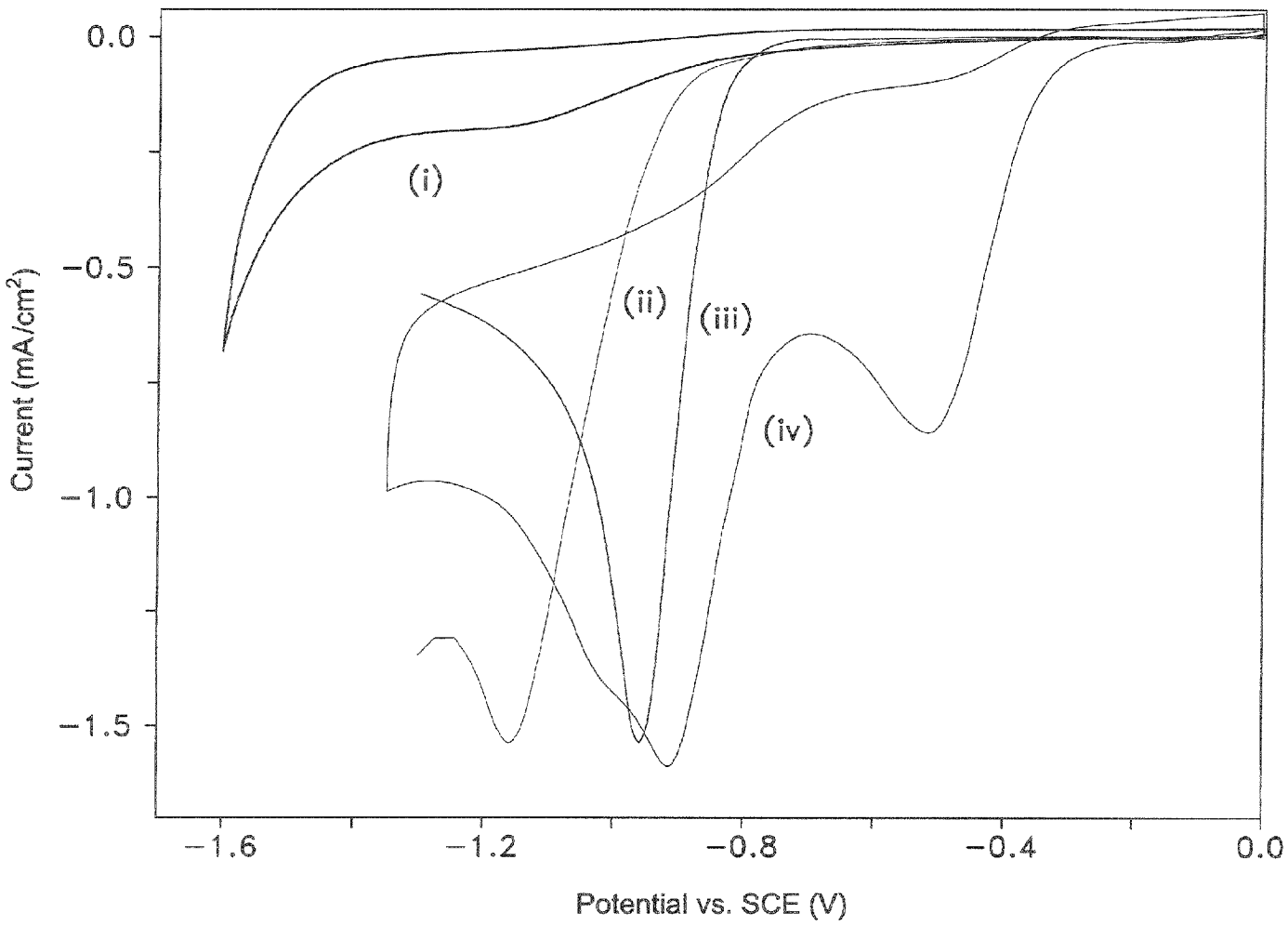
FIG. 3 is a cyclic voltammogram comparing (i) a plain $TiO_2$ electrode, (ii) a TON-as-anodized electrode, (iii) a TON-air electrode, and (iv) a TON-$N_2$ electrode in a 1.0 M KOH solution at 50 mV/s.

The electrochemical activity of TON-$N_2$, TON-air, and TON-as anodized (without further annealing) array electrodes was further investigated for the oxygen reduction reaction (ORR) in $O_2$ saturated alkaline solution. FIG. 3 shows the cyclic voltammograms for electrodes at 50 mV/s in 1.0 M KOH. For comparison, cyclic voltammograms are also shown for plain $TiO_2$ prepared by anodizing Ti foil in 1.0 M $H_2SO_4$.

In the presence of oxygen, the plain $TiO_2$ electrode exhibits a low current plateau in the potential region from −1.0 to −1.5 V vs. SCE, as expected for the impeded $4e^-$ reduction of oxygen. The TON-as anodized and TON-air electrodes display a distinct reduction peak at −1.16 V and at −0.93 V vs. SCE, respectively, with the cathodic peaks indicating mass transport controlled reduction and peak currents, on average, of 1.5 $mA/cm^2$. In comparison to plain $TiO_2$, it can be seen that the nano-structuring and heat treatment of $TiO_2$ improved the conductivity and reactivity with a significant positive potential shift of 230 mV for the oxygen reduction process. This may be due to the larger surface area of nanotube arrays, as well as the formation of a dense anatase crystalline phase of $TiO_2$ (as confirmed by SEM and X-ray diffraction and impedance analysis). The electrochemical reduction of oxygen in alkaline solutions at $TiO_2$ electrodes prepared by thermal decomposition and electrochemical activation is known, and occurs via one $4e^-$ reduction peak at potentials close to −1.1 V vs. SCE to produce water. Oxygen reduction is likely to be mediated by Ti(III/IV) surface redox sites with associated adsorption and desorption steps. However, the production of small quantities of $H_2O_2$ during $O_2$ reduction using ring-disk analysis has been observed, leading to the conclusion that $H_2O_2$ can be an intermediate product in the $O_2$-reduction mechanism on the $TiO_2$ electrode.

This redox mediation mechanistic model can be applied to the TON-as anodized and TON-air electrodes, considering the improvement in the reduction kinetics and in the peak current. For the TON-$N_2$ electrode, significant differences can be seen. The cyclic voltammetry data in FIG. 3 show two distinct and well-separated chemically irreversible reduction peaks located at potentials of −0.48 and −0.85 V vs. SCE (curve (iv)). There is no back-oxidation peak observed during the reverse scan. The oxygen reduction potentials for both peaks are shifted positive compared to those for TON-air and TON-as anodized electrodes, which indicates better catalytic activity towards oxygen reduction.

Figure 4:
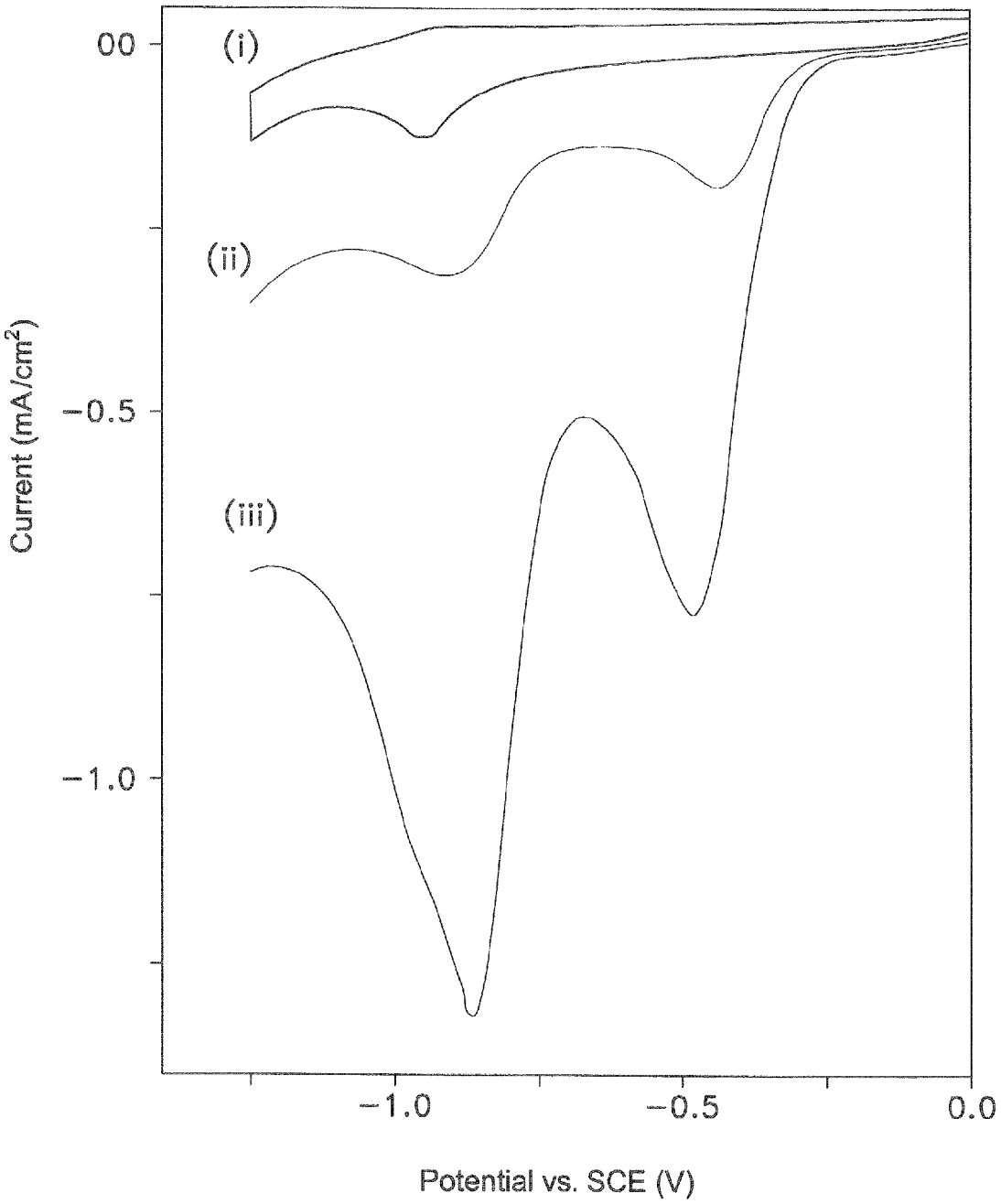
FIG. 4 is a graph showing cyclic voltammograms for the TON-$N_2$ electrode in a 1.0 M KOH solution at 50 mV/s, purged for 20 minutes with (i) pure nitrogen, (ii) air, and (iii) pure oxygen.

To confirm the mechanism for these two oxygen reduction peaks at the TON-$N_2$ arrays, the effect of oxygen concentration was investigated in alkaline solutions purged with $O_2$, air, or with $N_2$. FIG. 4 shows the cyclic voltammograms for the effect of oxygen concentration in 1.0 M KOH at a TON-$N_2$ electrode. The cyclic voltammetry response for the TON-$N_2$ electrode in completely deoxygenated solution (curve (i)) shows only a small reduction peak at −0.95 V, which is attributed to a $Ti^{3+}/Ti^{4+}$ surface redox process for TON-$N_2$ arrays. After purging the solution with air (curve (ii)), the two reduction peaks can be clearly seen. The current is significantly increased with increasing the oxygen concentrations by purging more pure $O_2$ gas (curve (iii)). These two peaks are due to the reduction of oxygen at TON-$N_2$ arrays, suggesting that the reduction process proceeds via two sequential reaction steps. At the first peak at potential −0.48 V, oxygen is reduced by two electrons to give $H_2O_2$ (or $HO_2^-$), which is followed at the second peak at potential of −0.85 V vs. SCE by a further two electron reductions to give water.

Additionally, after subtraction of the background current, the peak currents for both peaks in saturated oxygen solution are almost equal (0.77 mA/cm$^2$ and 0.80 mA/cm$^2$, respectively) which confirms that the same number of electrons are involved in each of the reduction steps. The approximate theoretical two-electron peak current based on the Randles-Sevcik equation and the value $D_{oxygen}=1.65\times10^{-5}$ cm/s is 0.7 mA/cm$^2$, in good agreement with these values.

Figure 5:
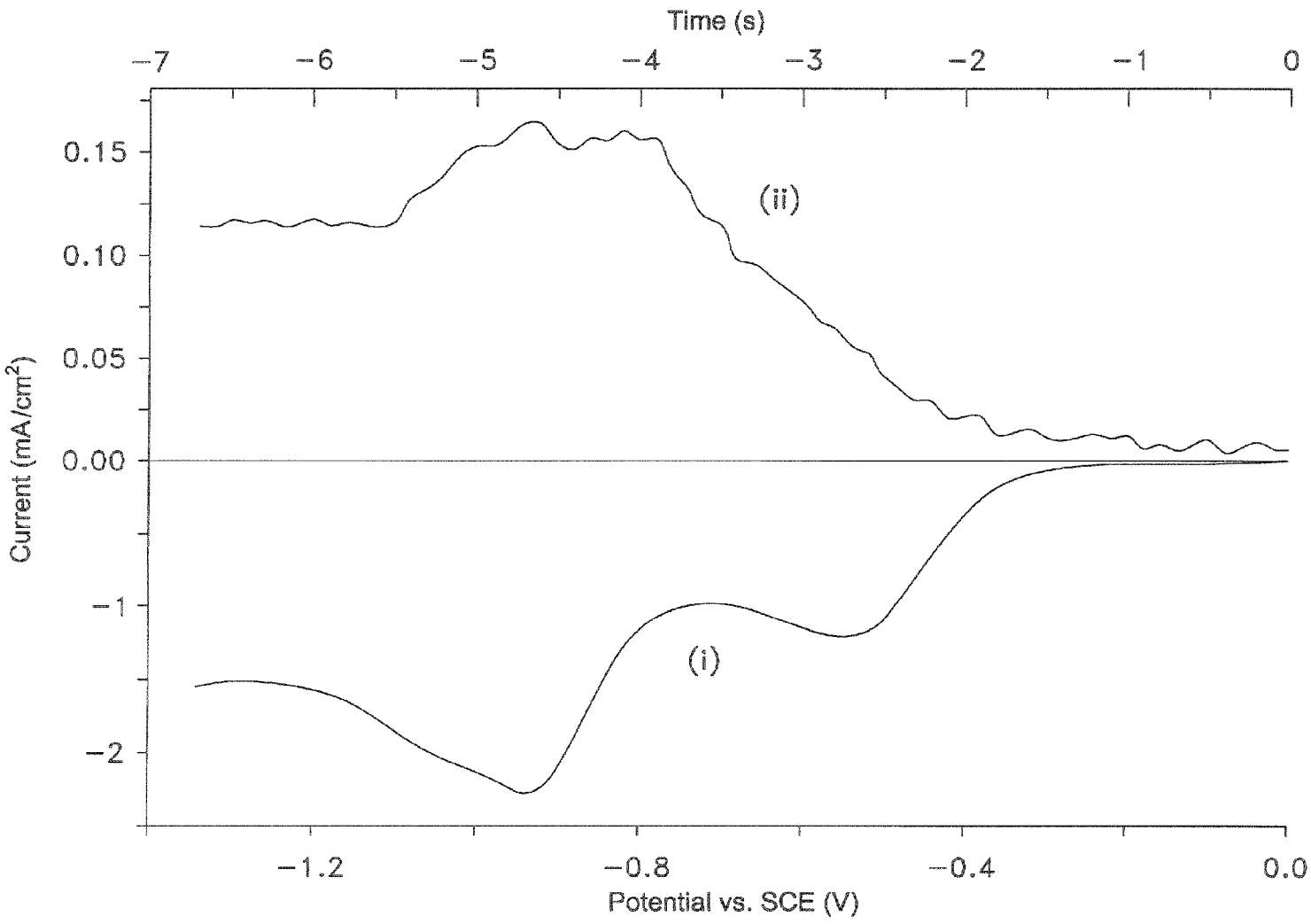
FIG. 5 is a linear sweep voltammogram for (i) a TON-$N_2$ cathode (generator) electrode in a 1.0 M KOH solution saturated with oxygen at 200 mV/s, compared against (ii) a corresponding Pt detector electrode at applied potentials of 0.8 V vs. SCE.

A generator detector system was used to investigate the release of $H_2O_2$ as an intermediate product during the oxygen reduction at the TON-$N_2$ electrode. A platinum detector electrode with a 1.0 mm diameter was mounted perpendicular and within 20 μm above the TON-$N_2$ generator electrode using an upright micro-stage. Using two synchronized potentiostat channels, the current time transient of the platinum detector electrode was recorded at constant potential, while linear sweep voltammetry was performed at the TON-$N_2$ generator electrode. FIG. 5 shows the current time transient at the platinum detector electrode at 0.8 V vs. SCE and the voltammogram for the TON-$N_2$ generator electrode at 200 mV/s in 1.0 M KOH saturated with oxygen.

Figure 6A:
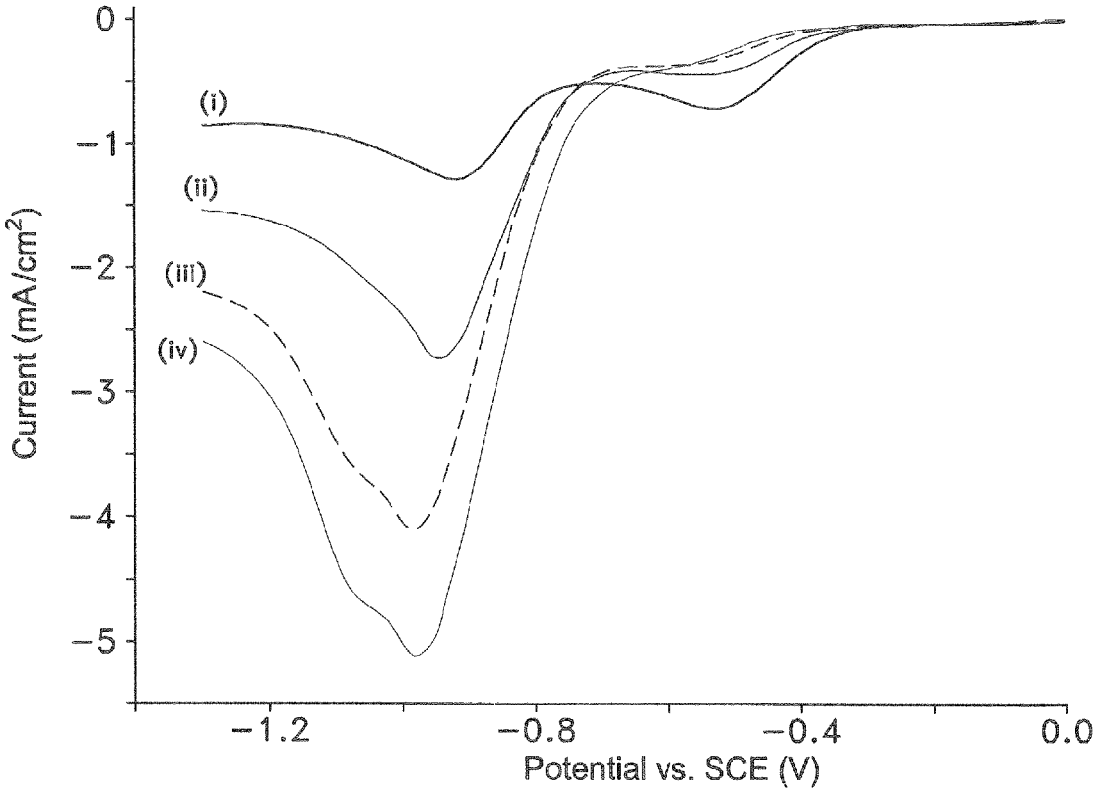
FIG. 6A is a cyclic voltammogram for the TON-$N_2$ electrode in a 1.0 M KOH solution at 50 mV/s (i) in oxygen-saturated solution, and after the addition of (ii) 10 μL of $H_2O_2$, (iii) 20 μL of $H_2O_2$, and (iv) 30 μL of $H_2O_2$.

The TON-$N_2$ generator electrode data show the presence of two oxygen reduction peaks. At the onset of the first peak, the Pt detector electrode shows an increase in anodic current, reaching a maximum at the onset potential of the second peak (curve (ii)). This is due to the formation of $H_2O_2$ intermediate product, which diffuses to the detector and undergoes oxidation at the Pt tip held at 0.8 V vs. SCE. This shows the production of $H_2O_2$ as a major product during the oxygen reduction at the first peak for TON-$N_2$ array electrodes. Thus, the production of $H_2O_2$ can be performed efficiently by controlling the potential of the cathode (generator) at about −0.5 V vs. SCE. To confirm the second peak is due to the reduction of $H_2O_2$, a set of experiments were carried out with successive addition of hydrogen peroxide aliquots. FIG. 6A shows the cyclic voltammograms for sequential addition of $H_2O_2$ aliquots into 1.0 M KOH solution at the TON-$N_2$ electrode.

Figure 6B:
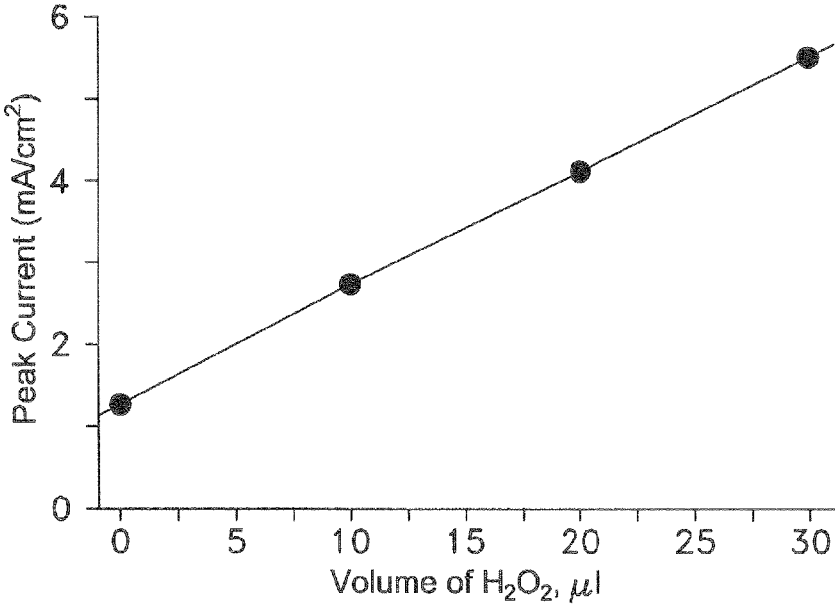
FIG. 6B is a graph showing a linear increase in current with the addition of $H_2O_2$ at the second peak of the voltammogram of FIG. 6A.

On addition of $H_2O_2$ aliquots (30 wt %), a sharp decrease in the first peak current can be seen, which completely disappeared after the addition of 30 μL of $H_2O_2$. Additionally, the second peak current shows a linear increase with increasing $H_2O_2$ concentration (see FIG. 6B) and the peak potential is slightly shifted to more negative potential. This shows that the $H_2O_2$ reduction takes place at the second peak. The loss of the first reduction peak may be due to blocking of reactive sites by peroxide.

X-ray photoelectron spectroscopy (XPS) analysis revealed that the O/Ti ratio is significantly increased from 2.25 to 3.5 after oxidizing the TON-$N_2$ arrays with $H_2O_2$ solution. We conclude that the addition of $H_2O_2$ leads to the oxidation of $Ti^{3+}$ sites to $Ti^{4+}$, reducing the number of oxygen vacancies at the surface, which also explains the disappearance of oxygen reduction at the first peak at the TON-$N_2$ array. It has been shown that the presence of oxygen vacancies boosts the charge transfer and that the rate of oxygen reduction linearly depends on the oxygen vacancies density. This may be attributed to the enhancement of the $TiO_2$ conductivity, as well as the surface oxygen vacancies acting as catalytic sites for oxygen reduction. The kinetic order of the reaction with respect to vacancies concentration has been found to be greater than zero, indicating the participation of the oxygen vacancies as catalytic sites. Thus, the presence of the oxygen reduction first peak (−0.45 V vs. SCE) at TON-$N_2$ arrays can be explained based on higher levels of surface oxygen vacancies.

Figure 7A:
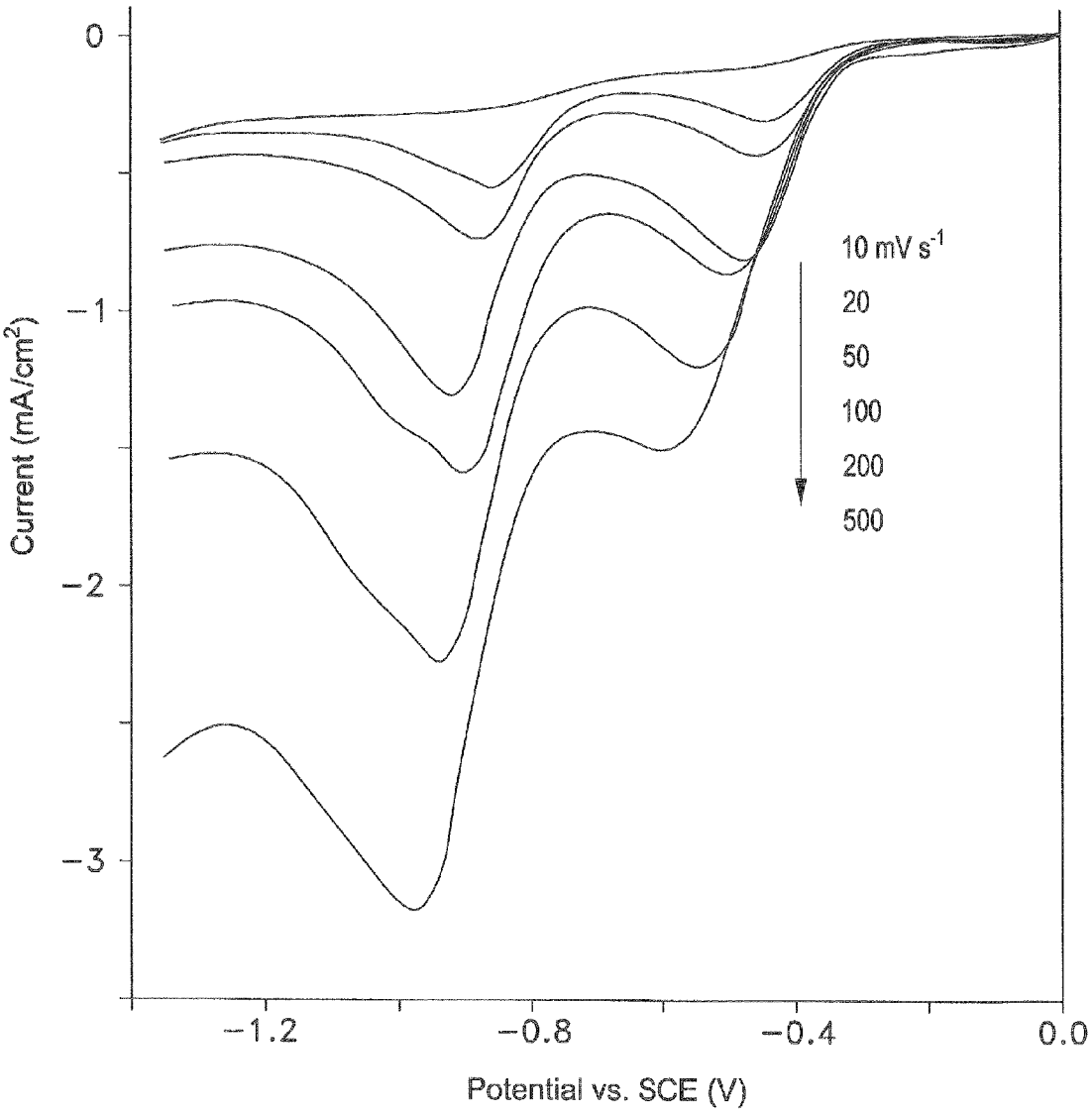
FIG. 7A is a cyclic voltammogram for the TON-$N_2$ electrode in a 1.0 M KOH solution saturated with oxygen at different scan rates.
Figure 7B:
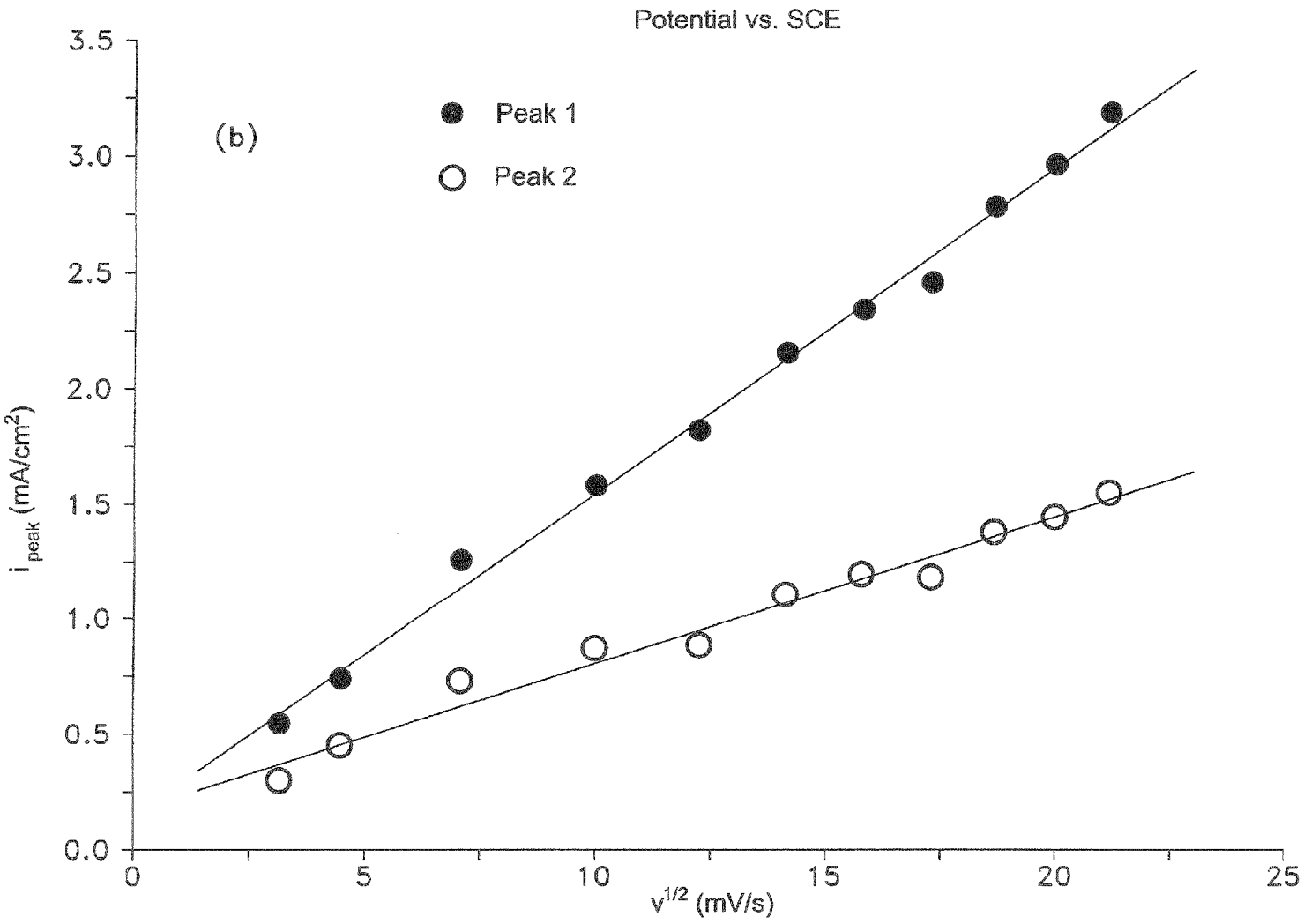
FIG. 7B is a plot of peak currents vs. square root of scan rate for the cyclic voltammogram of FIG. 7A.
Figure 7C:
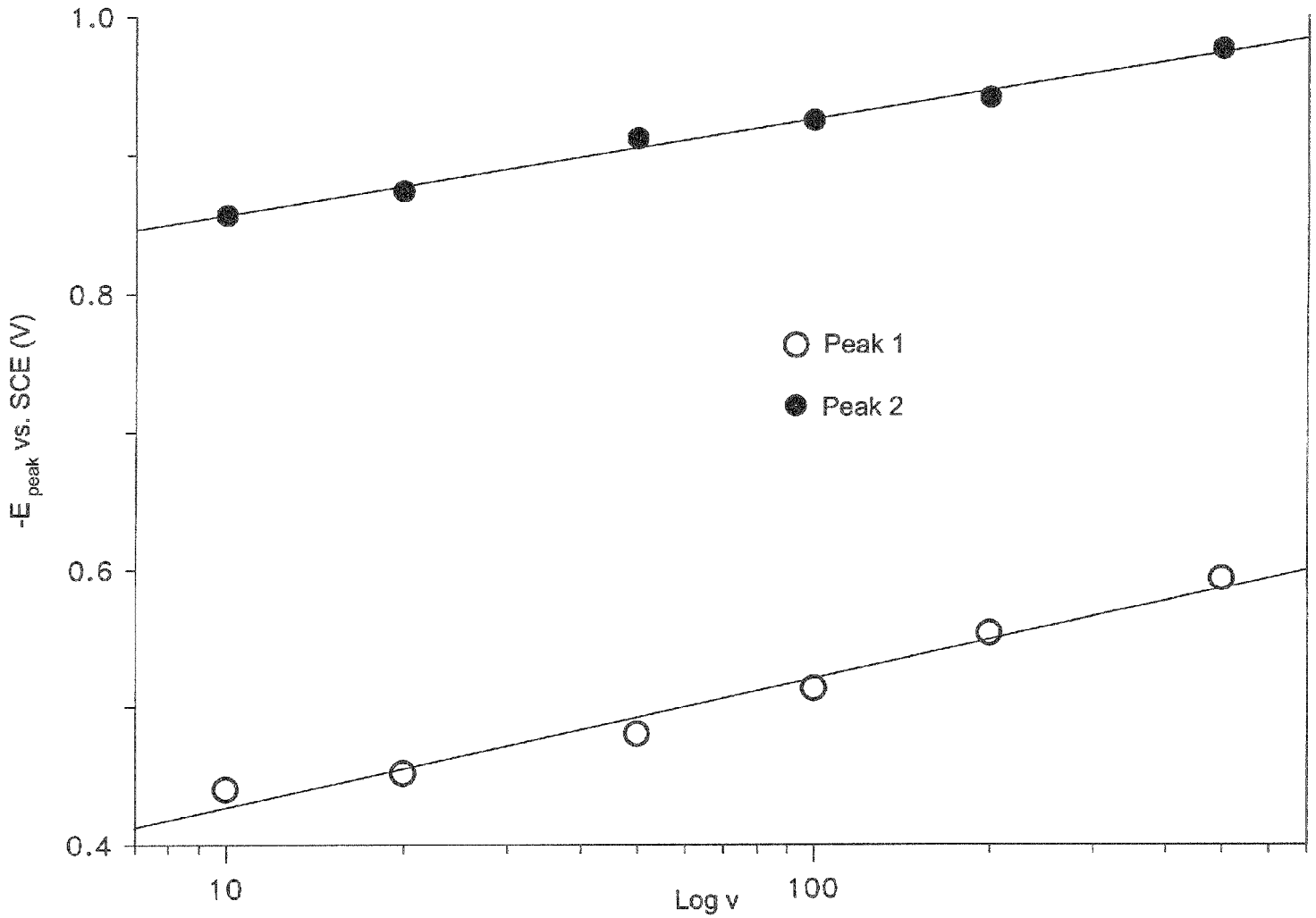
FIG. 7C is a plot of peak potentials vs. the logarithm of the scan rate for the cyclic voltammogram of FIG. 7A.

FIG. 7A shows the effect of the scan rate on the ORR process at TON-$N_2$ arrays in 1.0 M KOH saturated with $O_2$. The relationship between the two cathodic peaks current and the square root of scan rate is shown in FIG. 7B. The data show that for a TON-$N_2$ electrode, both oxygen reduction peak currents increase linearly with the square root of potential scan rate, suggesting that the overall ORR process at this electrode is controlled by the diffusion of $O_2$ from solution to the oxygen vacancies at surface sites. Additionally, the peak potential was linearly shifted to a more negative potential as a function of logarithm of the scan rate for both peaks, as shown in FIG. 7C. This suggests that there is some degree of electron transfer kinetic contribution or resistivity contribution to the peak current and that the overall reaction is under mixed control. This is evident from the intercept in the relation of peak current and the square root of scan rate in FIG. 7B. As described above, by oxidizing the surface of the TON-$N_2$ array using $H_2O_2$, the first peak for the oxygen reduction is completely suppressed and the arrays start to behave similar to as-anodized and TON-air electrodes. However, the first reduction peak can be recovered by re-annealing the $H_2O_2$ treated sample at 450° C. in nitrogen atmosphere for three hours.

Figure 8:
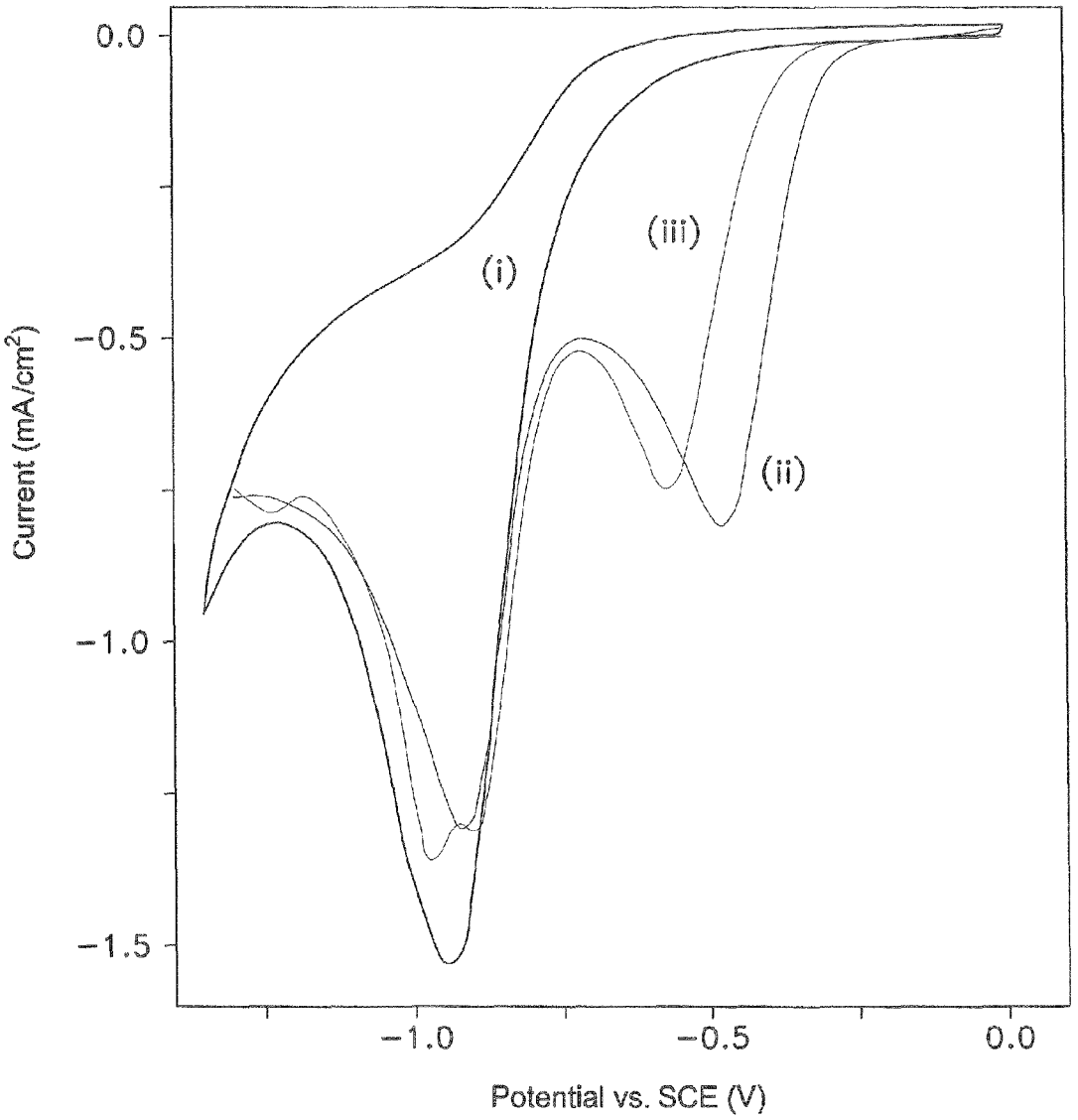
FIG. 8 is a graph showing a cyclic voltammogram in a 1.0 M KOH solution saturated in oxygen at 50 mV/s for: (i) the TON-$N_2$ electrode, (ii) a TON-$N_2$ electrode after treatment with $H_2O_2$, and (iii) a TON-$N_2$ electrode treated with $H_2O_2$ and re-annealed in nitrogen atmosphere.

FIG. 8 shows the cyclic voltammograms in 1.0 M KOH for: (i) a TON-$N_2$ electrode, (ii) a TON-$N_2$ electrode after treatment with $H_2O_2$, and (iii) a TON-$N_2$ electrode treated with $H_2O_2$ and re-annealed in nitrogen atmosphere. As shown, the first oxygen reduction peak is completely recovered after re-annealing. However, the peak potential is slightly shifted to a more negative potential, which may be due to fewer oxygen vacancies being formed. The freshly prepared TON-$N_2$ electrodes are highly stable at room temperature, and the cyclic voltammograms were found to be reproducible for several cycles on different days. After extensive storage in open atmosphere and at ambient temperature, the TON-$N_2$ electrodes were found to show the same characteristics, except that the first reduction peak potential was slightly shifted to a more negative potential.

It is to be understood that the present invention is not limited to the embodiments described above, but encompasses any and all embodiments within the scope of the following claims.

We claim:

1. An electrochemical method of producing hydrogen peroxide using a titanium oxide nanotube catalyst, comprising the steps of:

immersing an anode and a cathode in an alkaline solution saturated with oxygen in an electrolytic cell, the cathode being a nanostructured titania ($TiO_2$) electrode surface treated with nitrogen;

establishing an electrical potential across the cathode and the anode to initiate electrochemical reduction of the oxygen in the alkaline solution to produce hydrogen peroxide dissolved in the alkaline solution; and collecting the hydrogen peroxide dissolved in the alkaline solution.

2. The electrochemical method of producing hydrogen peroxide using a titanium oxide nanotube catalyst according to claim 1, wherein said cathode comprises an anodized $TiO_2$ nanotube array annealed in nitrogen atmosphere.

3. The electrochemical method of producing hydrogen peroxide using a titanium oxide nanotube catalyst according to claim 1, wherein the alkaline solution comprises KOH solution saturated with oxygen.

4. The electrochemical method of producing hydrogen peroxide using a titanium oxide nanotube catalyst according to claim 1, wherein the alkaline solution comprises 1.0M KOH solution saturated with oxygen.

5. The electrochemical method of producing hydrogen peroxide using a titanium oxide nanotube catalyst according to claim 1, wherein said anode is formed from a material selected from the group consisting of: nickel, nickel mesh, Raney nickel, and platinum.

6. An electrochemical method of producing hydrogen peroxide using a titanium oxide nanotube catalyst, comprising the steps of:

adding an aqueous alkaline electrolytic solution saturated with oxygen to an electrolytic cell;

immersing an anode in the electrolytic solution;

immersing a cathode formed from a $TiO_2$ nanotube array surface-treated with nitrogen in the electrolytic solution;

applying an electric potential between the anode and the cathode to initiate electrochemical reduction of the oxygen in the alkaline solution; and collecting hydrogen peroxide generated at the cathode during the electrochemical reduction of oxygen in the electrolytic cell.

7. The electrochemical method of producing hydrogen peroxide using a titanium oxide nanotube catalyst according to claim 6, wherein the alkaline solution comprises KOH solution saturated with oxygen.

8. The electrochemical method of producing hydrogen peroxide using a titanium oxide nanotube catalyst according to claim 6, wherein the alkaline solution comprises 1.0M KOH solution saturated with oxygen.

9. The electrochemical method of producing hydrogen peroxide using a titanium oxide nanotube catalyst according to claim 6, wherein said anode is formed from a material selected from the group consisting of: nickel, nickel mesh, Raney nickel, and platinum.

* * * * *